US006722076B2

(12) United States Patent
Nielsen

(10) Patent No.: US 6,722,076 B2
(45) Date of Patent: Apr. 20, 2004

(54) APPARATUS AND METHOD FOR ATTACHING DEVICES TO A WEAPON

(76) Inventor: Douglas E. Nielsen, 1890 W. 400 South, North Judson, IN (US) 46366

( * ) Notice: Subject to any disclaimer, the term of this patent is extended or adjusted under 35 U.S.C. 154(b) by 0 days.

(21) Appl. No.: 10/236,693

(22) Filed: Sep. 6, 2002

(65) Prior Publication Data

US 2004/0045209 A1 Mar. 11, 2004

(51) Int. Cl.[7] ..... F41G 1/34

(52) U.S. Cl. ..... 42/146; 362/110; 42/90

(58) Field of Search ..... 42/113, 114, 115, 42/116, 117, 131, 132, 142, 146, 90; 362/110, 113, 114; 89/14.3, 14.4

(56) References Cited

U.S. PATENT DOCUMENTS

| | | | | |
|---|---|---|---|---|
| 3,513,581 A | | 5/1970 | Slater | |
| 4,510,843 A | * | 4/1985 | Rabatin | 89/14.4 |
| 4,627,183 A | | 12/1986 | Stuckman | 362/110 |
| 4,679,895 A | * | 7/1987 | Huber | 350/96.2 |
| 4,856,218 A | | 8/1989 | Reynolds, Jr. | 362/110 |
| 4,964,685 A | * | 10/1990 | Savitsky et al. | 350/96.2 |
| 5,282,594 A | * | 2/1994 | Huang | 248/205.1 |
| 5,613,316 A | | 3/1997 | Hightower | 42/85 |
| 5,727,346 A | * | 3/1998 | Lazzarini et al. | 42/103 |
| 5,816,683 A | * | 10/1998 | Christiansen | 362/110 |
| 5,860,242 A | * | 1/1999 | O'Neil | 42/97 |
| 2003/0090894 A1 | * | 5/2003 | Cummings | 362/110 |

FOREIGN PATENT DOCUMENTS

CH 654 655 A5 * 2/1986

OTHER PUBLICATIONS

"Tactically Advanced Combat Moount III, TACMIII", brochure, Diamond Products Marketing, Inc., 4 pages, date unknown.

"Lighting Products and Accessories" brochure, Optronics, 3 pages, 1999.

* cited by examiner

*Primary Examiner*—Stephen M. Johnson
(74) *Attorney, Agent, or Firm*—Barnes & Thornburg

(57) ABSTRACT

An apparatus for mounting a device, such as an illumination device or a collection device, to a weapon is provided. The apparatus comprises a mounting member configured to couple with the device and with the weapon in order to mount the device to the weapon.

23 Claims, 4 Drawing Sheets

APPARATUS AND METHOD FOR ATTACHING DEVICES TO A WEAPON

BACKGROUND AND SUMMARY OF INVENTION

The present invention relates to weapon mounts, and, more particularly, to an apparatus and method for mounting various devices, for example an illumination device, a collection device or other device, to a weapon.

It is known to attach devices to a weapon to facilitate using the weapon. Such devices, such as for example an illumination device, typically attach to a weapon's barrel or targeting scope using a clamp or other external attachment means. Alternatively, in the case of some illumination devices, such devices may be carried inside the weapon itself. Examples of such devices are found in U.S. Pat. Nos. 3,513,581; 4,627,183; and 4,856,218.

Briefly, the present invention comprises one or more of the following features alone or in combination in accordance with the illustrative embodiments. In one embodiment of the present invention, a mounting apparatus for coupling a device to a weapon is provided. The mounting apparatus comprises

- a mounting member comprising a gripping end configured to couple the device to the mounting member, and
- a mounting end configured to couple the mounting member to the weapon.

In another illustrative embodiment, a method of mounting a device to a weapon is provided. The method comprises the steps of:

- providing a mounting member,
- coupling together the mounting member and the weapon, and
- coupling together the mounting member and the device.

In yet another illustrative embodiment, an apparatus for mounting a device to a weapon having a substantially cylindrical magazine having an open end configured with threads is provided. The apparatus comprises:

- a mounting member configured to be received within the magazine, the mounting member comprising a threaded gripping end, and
- a threaded retaining member configured to engage the magazine threads and the gripping end threads,
- gripping end comprising a cavity configured to receive the device,
  - wherein advancement of said retaining member threads along said gripping end threads couples together the device and the mounting member and advancement of said retaining member threads along said magazine threads couples the mounting member to the weapon.

Features of the invention will become apparent to those skilled in the art upon consideration of the following detailed description of the preferred embodiments exemplifying the best mode of carrying out the invention as presently perceived.

DETAILED DESCRIPTION OF THE DRAWINGS

Figure 1:
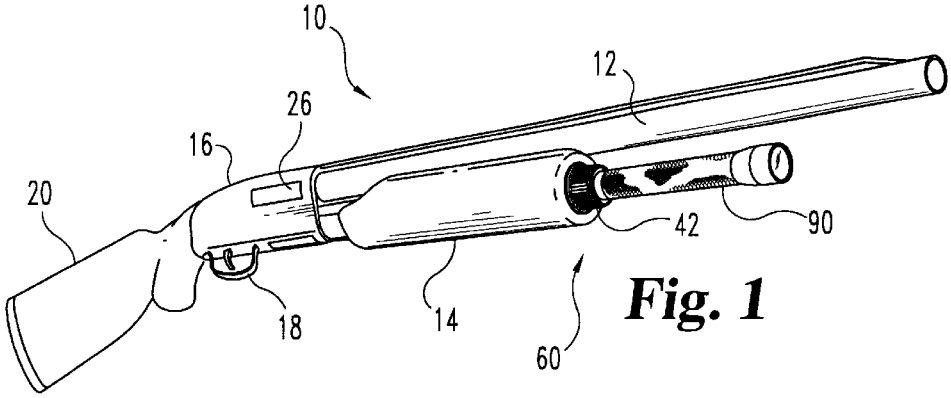
FIG. 1 is a perspective view of a shotgun fitted with an illustrative embodiment of the invention mounting a flashlight illumination device.

For the purposes of promoting an understanding of the principles of the invention, reference will now be made to the illustrative embodiments depicted in the drawings and described herein below. It will nevertheless be understood that no limitation of the scope of the invention is thereby intended, such alterations and further modifications in the illustrated apparatus, and such further applications of the principles of the invention as illustrated therein being contemplated as would normally occur to one skilled in the art to which the invention relates.

It will be understood that the same reference numerals are utilized for like elements throughout the various embodiments and similar reference numerals, incremented by one hundred, are used for similar elements. Referring to FIG. 1, an illustrative embodiment of a mounting apparatus 60 in accordance with the present invention is depicted on a weapon, illustratively, a shotgun 10 such as, but not limited to a Remington Magnum Wingmaster Model 870, 12 gauge, pump-action, five-shot shotgun. The invention is adaptable for use with other types of weapons, such as rifles, pistols, bows (FIG. 12), paint ball guns, BB guns, assault weapons, and the like. Such an illustrative shotgun 10 typically comprises a barrel 12, a forestock 14, a receiver 16, a trigger assembly 18, and a butt stock 20. The receiver 16 is sandwiched between, and is configured to receive, the butt stock 20 and the barrel 12, and carries the trigger assembly 18 thereon. The barrel 12 is supported on top of the forestock 14, which is movably mounted to a magazine 22, which feeds ammunition, such as shells, into a chamber 26. The receiver 16 also receives the magazine 22 and houses the action (not shown), which includes the chamber 26. Manual movement of the forestock fore and aft actuates the action to feed shells for firing into, and to eject spent shells from, the chamber 26 one at a time.

Figure 2:
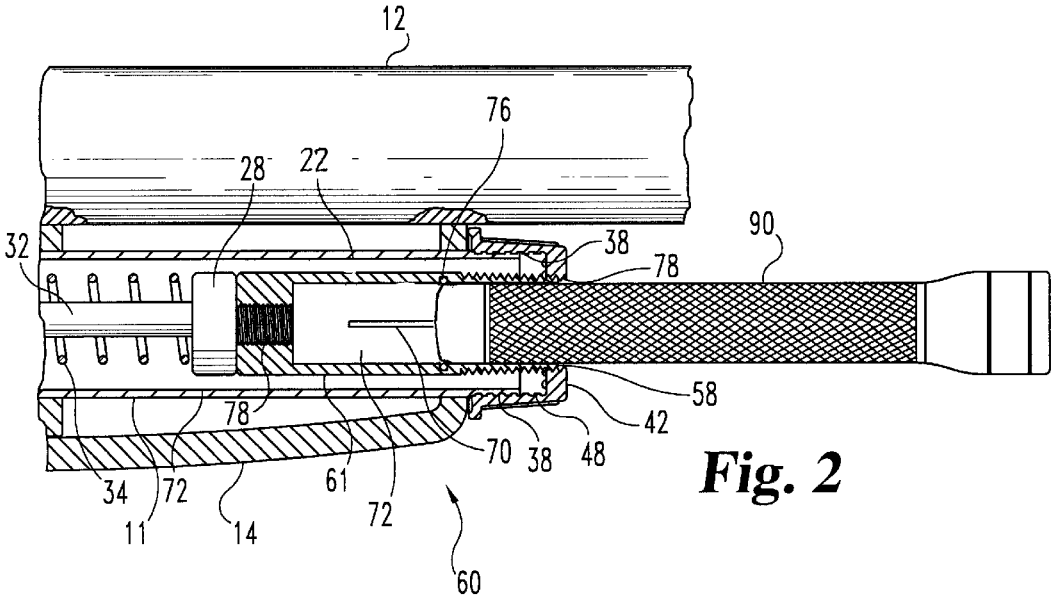
FIG. 2 is an enlarged longitudinal sectional view of that portion of the shotgun of FIG. 1 embodying an illustrative embodiment of the invention.
Figure 3:
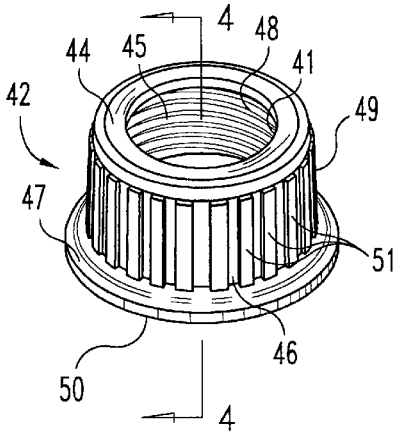
FIG. 3 is a perspective view of an illustrative retaining member configured for use with the illustrative embodiments.
Figure 4:
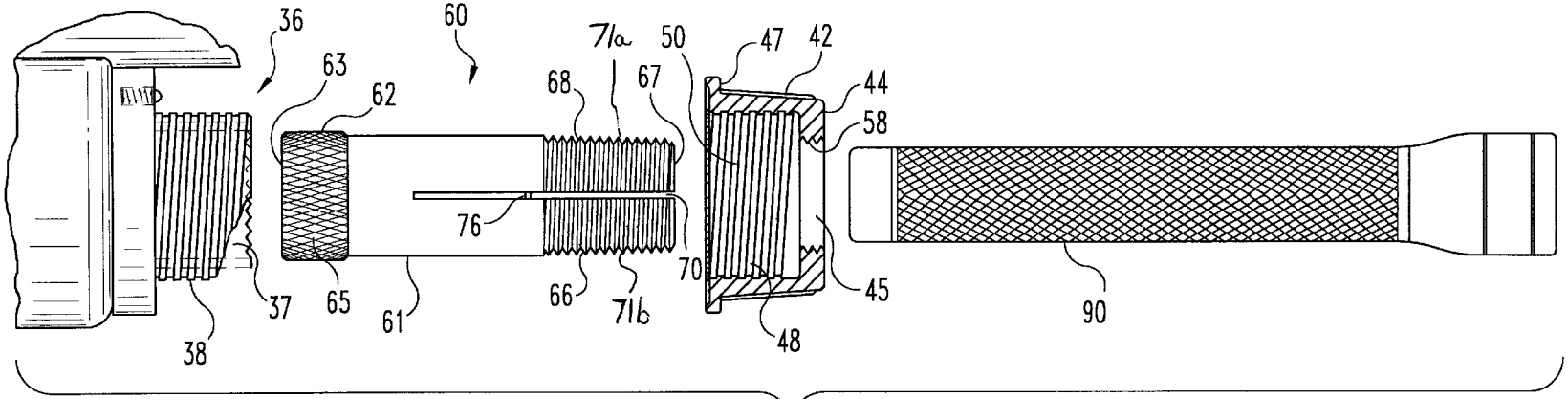
FIG. 4 is an exploded sectional view of the illustrative embodiments depicted in FIGS. 1 and 2 with a sectional view of the illustrative retaining member taken generally along the line 4–4 of FIG. 3.

As best seen in FIG. 2, the magazine 22 comprises a longitudinal chamber or tube 11 having a generally cylindrical cross section and extending longitudinally forwardly from the receiver 16 toward, and in general longitudinal alignment with, the discharge end of the barrel 12. The magazine 22 terminates in a forward end portion 36 having an opening or aperture 37. The end portion 36 extends beyond the forestock 14 and includes external threads 38. The magazine 22 holds generally one or more shells for feeding into the chamber 26 and its opening 37 is closed at the end portion 36 by a magazine cap or retaining member 42, which also retains the barrel 12 within the receiver 16. The retaining member 42 also retains within the magazine 22 a spring-retaining cap and ring (not shown), which in turn retain a feed spring 34. The retaining member 42 illustratively is an annular cap comprising an annular end panel or flange 44 having a central opening 45, and a peripheral skirt 46 depending generally downwardly from the annular flange 44 and terminating in a generally outwardly extending peripheral flange 47. As best seen in FIGS. 3 and 4, the skirt 46 defines a cavity 50 and comprises an inwardly facing surface 41 and an outwardly facing surface 49. The inwardly facing surface 41 includes internal threads 48. The diameter of the cavity 50 at the peripheral flange 47 generally may be greater than the diameter of the cavity at the central opening 45. The external threads 38 of the magazine and the internal threads 48 of the retaining member 42 are configured to cooperatively and threadably engage each other to attach or detach the retaining member 42 relative to the magazine 22 in a conventional manner as described, for example, in U.S. Pat. No. 5,613,316, which is now incorporated by reference herein. In the illustrative embodiment, the outwardly facing surface 49 of the peripheral skirt 46 includes a plurality of generally axially extending parallel ridges 51, which facilitate nonslip gripping of the retaining member 42. In alternative embodiments, the outer wall of the peripheral skirt 46 may include alternative nonslip surfaces, such as, for example, a knurled surface. The magazine 22 also may include a longitudinally extending rod 32 configured with a plug 28 as illustrated in FIG. 2.

The construction and operation of the preceding components is conventional and well known in the shotgun art with the exception of the retaining member 42. Conventional shotgun magazine caps typically do not include a central opening. Therefore, in the illustrative embodiments, a conventional magazine cap is modified include the central opening 45 in any number of suitable ways. For example, a conventional cap may have the opening 45 drilled, punched, or bored through its end face. Alternatively, a retaining member 42 could be manufactured with the central opening 45 from original tooling. The flange 44 illustratively comprises internal threads 58. Also, it will be appreciated, that the conventional rod 32 may be shortened, or the rod 32 and plug 28 combination omitted entirely depending on the number of shells desired to be carried by the magazine 22 and the sizing of the mounting apparatus 60 as will be further explained below.

As best seen in FIG. 4, an illustrative embodiment of the mounting apparatus 60 comprises the retaining member 42 and a mounting member 61. The mounting member 61 comprises a longitudinal tube having a generally cylindrical cross section and extending longitudinally forwardly from a mounting end 62 toward a tapered gripping end 66. The mounting end 62 includes a face 63 having a central opening 64 configured with internal threads 78. The gripping end 66 comprises external threads 68 and a chamber or cavity 72 having an opening 67. The gripping end external threads 68 and the internal threads 58 of the flange 44 are configured to cooperatively and threadably engage each other to couple the retaining member 42 relative to the mounting member 61. Because the diameter of the cavity 50 at the peripheral flange 47 is generally greater than the diameter of the central opening 45, the engagement of internal threads 48 with external threads 38 is independent of the engagement of internal threads 58 with external threads 68. It will be appreciated, however, that the diameters of the cavity 50 and the opening 45 could be the same and still allow unimpeded engagement of threads 38 with threads 48 and of threads 58 with threads 68. Similarly, a common set of threads could be used to engage both the magazine threads 38 and the gripping end threads 68. The threads 68 includes one or more circumferentially spaced-apart apertures 70 extending longitudinally rearwardly from the mounting end 62 back toward the mounting end 62. The one or more apertures 70 divide the gripping end 66 into a plurality of gripping portions 71, which collapse around a device 90, such as for example an illumination or collection device, as will be explained. The mounting end 62 is depicted with a knurled gripping surface 65 in the illustrative embodiment shown in FIG. 4. Alternative embodiments may have alternative gripping surfaces, or no particular gripping surface at all.

Figure 7:
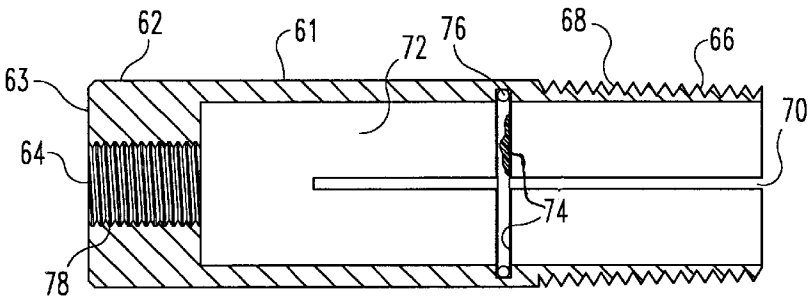
FIG. 7 is a sectional view of the illustrative mounting member of FIG. 6 taken generally along the line 7–7 in FIG. 6 and showing a portion of an O-ring with a portion of the O-ring cut away to reveal the wall of an aperture within which the O-ring resides.

Referring to FIG. 7, an illustrative embodiment of the mounting member 61 will be further explained. The illustrative mounting member 61 is formed from a solid aluminum bar, which is shaped on a lathe into an elongated tube with a generally cylindrical cross-section. As is known to those skilled in the art, other materials and methods of manufacture may be used. For example, the mounting member 61 could be made of any suitable metallic, nonmetallic, synthetic or composite material, alone or in combination, such as zinc, titanium, plastic, ceramic, acetal resin, synthetic resinous plastic, or KEVLAR. Similarly, alternative methods of manufacture suitable to the material being used, alone or in combination, such as die-casting or extrusion could be employed.

Illustratively, the mounting member 61 has a length of approximately three inches with an outer diameter at the mounting end 62 of about 0.900 inches tapering the last inch to about 0.860 inches toward the retaining end. The inside of the mounting member 61 is illustratively bored to form an elongated gripping cavity 72 having a generally cylindrical cross-section. The cavity 72 is bored from the gripping end 66 about two-and-one-half inches inwardly toward the mounting end 62, with an inner diameter of about 0.7187 inches generally throughout.

Figure 6:
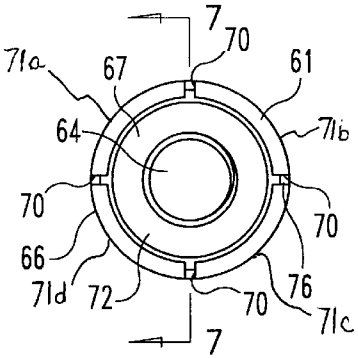
FIG. 6 is an end-on view of an illustrative mounting member.
Figure 5:
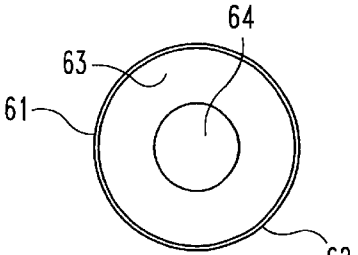
FIG. 5 is a bottom plan view of an illustrative mounting member.

Illustratively, the last approximately one-half inch of the mounting end 62 is generally solid with a ⅜ inch opening or bore 64 formed generally in the center thereof. This opening 64 includes threads 78 having about a 24 thread count and is configured to receive a conventional ⅜ inch bolt as alternative structure for attaching the mounting apparatus 60 to a shotgun 10 such as a bow 110 (FIG. 12), or for attaching a magazine plug 28 to the mounting member 61, as will be described below. As noted above, and as for example shown in FIG. 4, the outer surface of the mounting end 62 may, but need not be knurled from about a half inch to about an inch to facilitate gripping by a user affixing a device 90, such as an illumination or collection or other device as will be described. The outer surface of the gripping end 66 illustratively has a ⅞ inch thread with a 14 thread count, which extends from the gripping opening 67 rearwardly about one inch toward the mounting end and is configured to engage the retaining member 42 as previously described. Illustratively, four longitudinally extending apertures 70 are cut into the mounting member 61. The apertures 70 are circumferentially spaced at approximately 90 degree angles from each succeeding and preceding aperture, and they extend from the gripping opening 67 downwardly approximately 2 inches toward the mounting end 62 illustratively forming four collapsible gripping portions 71*a*–71*d* (FIG. 6). Those skilled in the art will appreciate that the mounting member 61 may have fewer than four apertures 70, or greater than four apertures and still be able to grip the device to be mounted. For example, the illustrative mounting member 61 of FIG. 4 depicts only one aperture 70 dividing the gripping end 66 into two gripping portions 71*a* and 71*b*. The gripping cavity 72 has an aperture 74 located approximately one inch down from the gripping opening 67 and extending around the inner circumference of the cavity 72. The aperture 74 is configured to house a compressible member 76 such as an O-ring. For example an O-Ring with a thickness of about one-sixteenth of an inch, and a diameter of about 0.74 to 0.80 inches may be inserted into the aperture 74 to aid in the gripping of the device.

Figure 10:
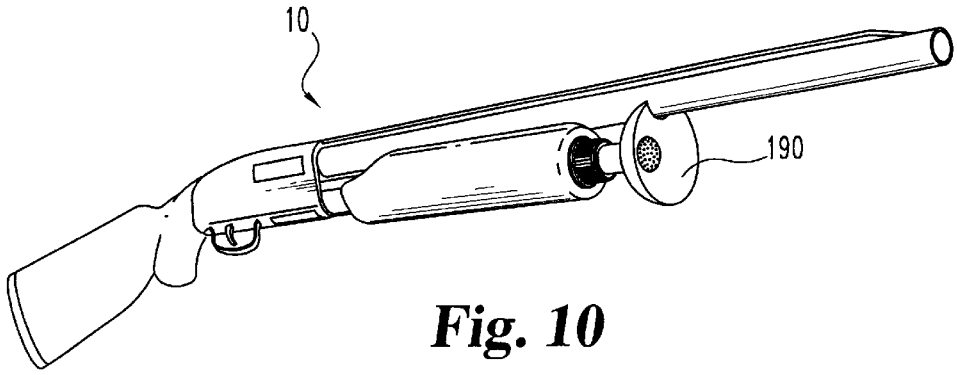
FIG. 10 is a perspective view of a shotgun fitted with an illustrative embodiment of the invention mounting a sound collection device.
Figure 11:
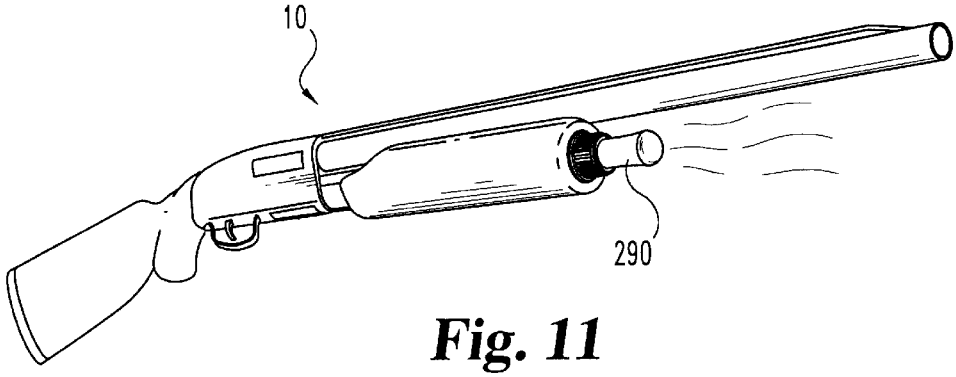
FIG. 11 is a perspective view of a shotgun fitted with an illustrative embodiment of the invention mounting an odor collection device.

In operation, the retaining member 42 is partially threaded onto the mounting member 61 and the device 90 is inserted through the opening 67 and into the cavity 72 of the mounting member 61 until the device and the compressible member 76 abut. For example, in the embodiment depicted in FIGS. 1 and 2, an illumination device, such as flashlight 90, for example a mini MAGLITE® AA, is used. It will be appreciated that the illustrative embodiments are adaptable for use with any number of other brands and types of flashlights. Similarly, the various embodiments may be adapted for use with other illumination or emission devices such as a laser designator or a range finder, or a paintball firing device. Similarly, the invention is adaptable for use with any type of collection device, such as a sound collector for example a microphone or sound collection dish 190 (FIG. 10), a camera or other video collection device, an infrared or other thermal imaging device, an olfaction or odor collection device or sniffer device 290 (FIG. 11), or a motion detector. Likewise a combination emission or illumination/collection device, such as an Identify Friend or Foe (IFF) or other a transponder/receiver device and the like may be accommodated.

Figure 8:
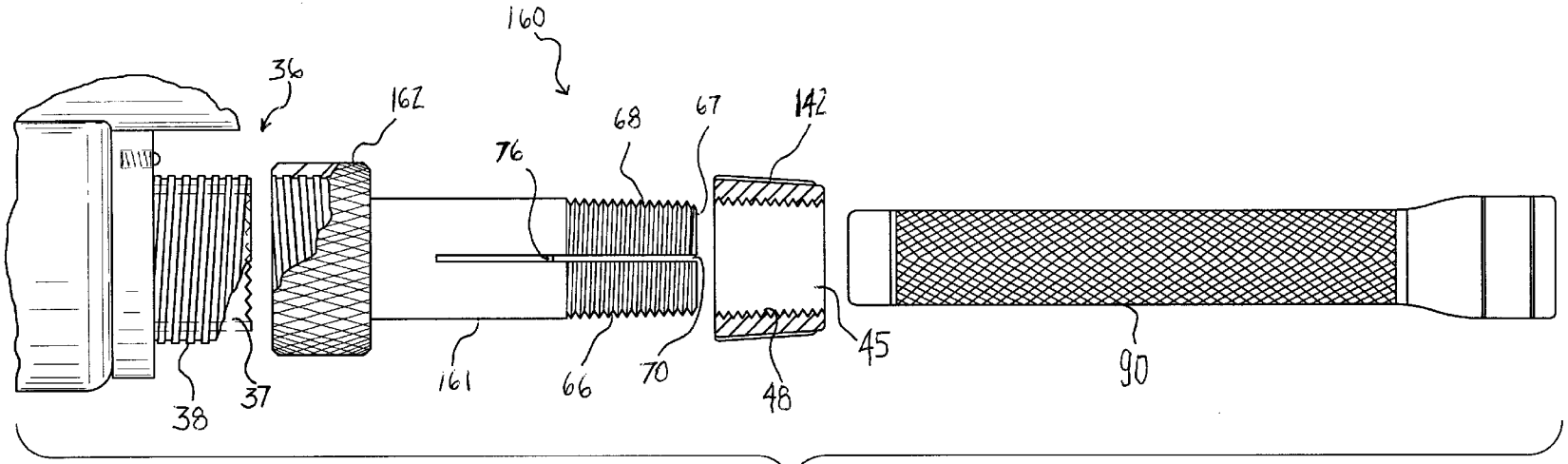
FIG. 8 is an exploded view of another illustrative embodiment with a sectional view of an illustrative retaining member taken generally along the line 4–4 of FIG. 3 and showing a cutaway portion of an illustrative mounting end.
Figure 9:
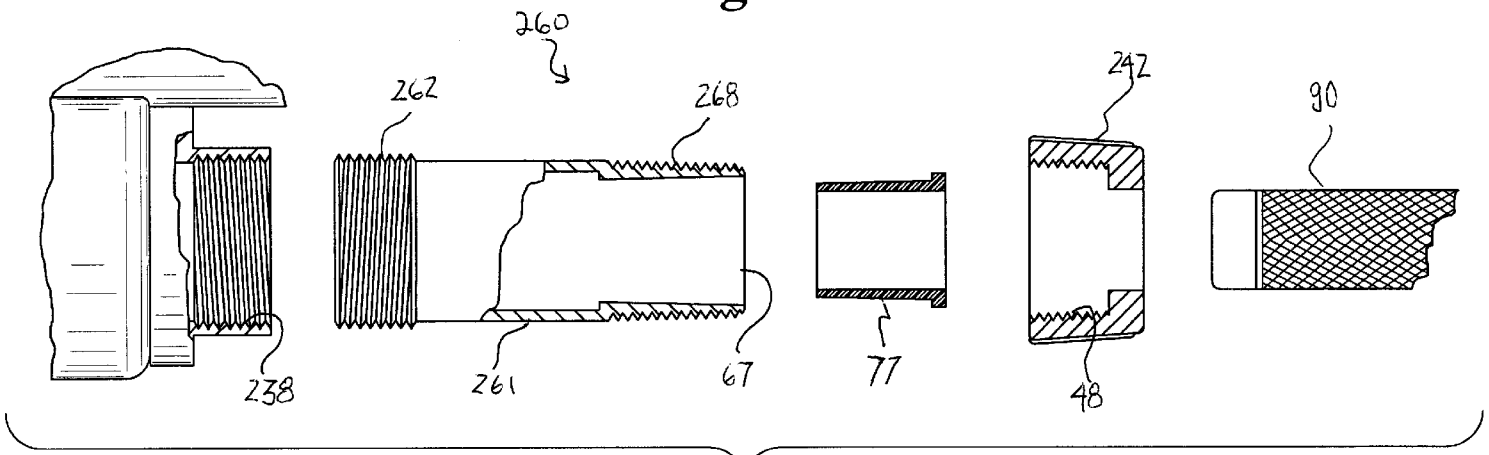
FIG. 9 is an exploded sectional view of another illustrative embodiment with a sectional view of another illustrative retaining member taken generally along the line 4–4 of FIG. 3 and showing a sectional view of an illustrative compressible member and a partial sectional view of an illustrative retaining member.

As the retaining member 42 is then tightened down on the mounting member 61 the retaining member threads 58 progress over the gripping end threads 68 downwardly over the tapered gripping end .66, and the gripping portions 71*a*–71*d* collapse to releasably grip the device 90, 190, 290. As noted, also as the retaining member 42 is tightened down, the compressible member 76 (FIGS. 2, 4, 6, 7, 8) aids in the gripping of the device 90, 190, 290. It will be appreciated that the device could also be inserted first and the retaining member 42 could then be threaded onto the mounting member 61. In an alternative embodiment depicted in FIG. 9, the mounting apparatus 260 further comprises a compressible member 77 which is disposed between the device 90, 190, 290 and the retaining member 242. As the retaining member threads 48 progress over the gripping end threads 268, the compressible member 77 grips the device 90, 190, 290. The compressible member 77 may be, for example, a gasket, and may couple the device 90, 190, 290 without the use of any gripping portions 71. For example, the mounting member 261 depicted in FIG. 9 is illustratively devoid of any longitudinal apertures 70. The compressible members 76 and 77 may be made of rubber or any other suitable compressible material and may be of any shape adaptable to the shapes of the particular device and mounting member.

Referring to FIG. 2, the mounting end 62 of the mounting apparatus 60 is inserted inside the magazine 22 and abuts against, and compresses the spring 34. For example, to insert the mounting apparatus 60 into the illustrative Model 870 shotgun, a user would break open the action and remove the spring-retaining cap (not shown) and ring (not shown), and remove the plug 28. Then the mounting member 61 would be inserted over the compressed spring 34 and into the magazine 22 until the threads 38 and 48 engaged. The portion of the mounting member 61 inside the magazine 22 occupies the space otherwise occupied by either a shell or a plug. Thus, the length of the portion of the mounting member 61 inside the magazine 22 may be dimensioned to modify, alone or in cooperation with a plug complementarily sized to exclude the desired number of shells from the magazine, the number of shells the magazine 22 may carry.

For example, if it were desired to reduce the capacity of a five-shell magazine to an operative capacity of three shells, then the portion of the mounting member 61 inside the magazine 22 could be constructed to have a length of one shell for cooperative use in conjunction with a one-shell plug, or, alternatively, the mounting member 61 could be constructed with a length of two shells for use alone, i.e., without a cooperating plug 28. It will be appreciated that the mounting member 61 could have a length of one, two, three, or more shells for use with no plug, or a plug of a suitable length to cooperate with the particular mounting member 61 to obtain the desired operative capacity for the magazine 22. Also, any plug 28 used in cooperation with the mounting apparatus 60 may be a conventional plug that the mounting member 61 is inserted over, or it may be integrated with the mounting member 61 by providing the plug 28 with a screw configured to threadingly engage the threads 78. If the plug 28 is screwed or otherwise mounted to the mounting member 61, then the rod 32 would be modified or eliminated as deemed appropriate to one skilled in the art.

It will be appreciated that the mounting member 61 and retaining member 42 may alternatively be dimensioned to accommodate coupling with other weapons in the manner just described. In addition, other means of coupling are contemplated by the invention. For example, FIG. 8 illustrates a mounting apparatus 160 having a mounting end 162 configured with threads 178 configured to mount the mounting member 161 directly to the magazine threads 38. In such a configuration, the mounting member 161 would have a retaining portion (not shown) to retain the plug 28, rod 32, and spring 34, if desired to reduce the number of shells that the magazine 22 could carry. Because the mounting member 161 attaches directly to the magazine threads 38, the retaining member 142 has only a single set of threads 48 configured to engage the gripping end threads 68. It is within the scope of the invention, however, for the retaining member 142 to be used in conjunction with mounting member 61 (FIG. 7) such that a single set of tapered threads 48 engage both the gripping end threads 68 and the magazine threads 38 of the weapon. It will also be appreciated by those skilled in the art that illustrative mounting apparatus 260 (FIG. 9) could include external threads 262 configured to mount directly to a weapon having internal threads 238. Similarly, the retaining member 242 is adaptable for use with compressible member 77 in any of the other illustrative mounting members 61, 161; thereby facilitating gripping of any device 90, 190, 290 by both the compressible member and the gripping portions 71.

Figure 12:
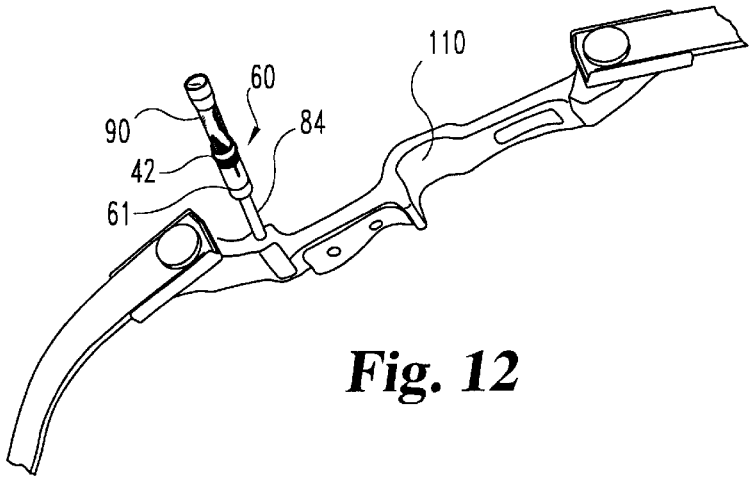
FIG. 12 is a perspective view of a bow fitted with an illustrative embodiment of the invention mounting a flashlight illumination device.

Referring to FIG. 12, yet another illustrative embodiment shows the mounting apparatus 60 mounted to a bow 110. The bow 110 has a bolt 84 configured to engage the threads 78 of the mounting member 61. It will be appreciated that the mounting apparatus 60 may similarly be mounted to other types of weapons or other items using the threads 78. In such cases, the size and shape of the mounting member 61 and the retaining member 42 would not be dependent upon the size and shape of a magazine 22. Therefore, the mounting apparatus 60 could be sized and shaped to accommodate a larger number of devices to be mounted. For example, the mounting apparatus 60 could have a rectangular or square cross section. Such is the case for the mounting members 161, 261 depicted in FIGS. 8 and 9, because they need not be inserted within the magazine 22.

While the invention has been illustrated and described in detail in the drawings and foregoing description, the same is to be considered as illustrative and not restrictive in character, it being understood that only certain illustrative embodiments have been shown and described and that all changes and modifications that come within the spirit of the invention are desired to be protected.

What is claimed:

1. A mounting apparatus for coupling a device to a weapon comprising a magazine, the mounting apparatus comprising:

a mounting member comprising a gripping end comprising threads configured to couple the device to the mounting member, a mounting end configured to couple the mounting member within the magazine of the weapon; and a retaining member having threads operable to engage the gripping end threads to couple the device to the mounting member.

2. The mounting apparatus of claim 1, wherein said gripping end is tapered and further comprises a cavity to receive the device.

3. The mounting apparatus of claim 1, further comprising a compressible member operable to grip the device as the retaining member threads advance along the gripping end threads.

4. The mounting apparatus of claim 3, wherein the compressible member comprises a gasket.

5. The mounting apparatus of claim 1, wherein the mounting member further comprises one or more longitudinal apertures dividing the gripping end into gripping portions that collapse around the device as the retaining member threads advance along the threads of the gripping end.

6. The mounting apparatus of claim 5, wherein the mounting end includes threads which engage threads on the weapon to couple the mounting apparatus to the weapon.

7. The mounting apparatus of claim 5, wherein the device comprises an illumination device.

8. The mounting apparatus of claim 5, wherein the mounting member has a substantially cylindrical cross-section and the one or more longitudinal apertures are circumferentially spaced-apart.

9. The mounting apparatus of claim 8, wherein the mounting end is received within an aperture of the weapon.

10. The mounting apparatus of claim 8, claim wherein the magazine includes threads and said retaining member threads are operable to engage said magazine threads to secure the mounting member.

11. The mounting apparatus of claim 10, wherein the retaining member threads comprise a first set of threads for engaging the gripping end and a second set of threads for engaging the magazine threads.

12. The mounting apparatus of claim 11, wherein the retaining member is annular and tapered.

13. A method of mounting a device to a weapon having a threaded magazine comprising the steps of:

providing a mounting member comprising a threaded gripping end, providing a threaded retaining member configured to couple together the mounting member and the weapon and the mounting member and the device coupling together the mounting member and the weapon by engagement of the threaded retaining member and the magazine threads, and coupling together the mounting member and the device.

14. The method of claim 13, wherein the mounting member further comprises a mounting end and wherein the threaded gripping end comprises a cavity to receive the device and one or more circumferentially spaced-apart apertures dividing the gripping end into gripping portions, the method further comprising steps of:

inserting the device into the gripping end cavity, advancing the retaining member threads along the gripping end threads to collapse the gripping portions about the device to couple together the gripping end and the device, inserting the mounting end into the magazine, and advancing the retaining member threads along the magazine threads to couple together the mounting member and the weapon.

15. An apparatus for mounting a device to a weapon having a substantially cylindrical magazine having an open end configured with threads, the apparatus comprising:

a mounting member configured to be received within the magazine, the mounting member comprising a threaded gripping end, and a threaded retaining member configured to engage said magazine threads and said gripping end threads, said gripping end comprising a cavity configured to receive the device, wherein advancement of said retaining member threads along said gripping end threads couples together the device and the mounting member and advancement of said retaining member threads along said magazine threads couples the mounting member to the weapon.

16. The apparatus of claim 15, further comprising a compressible member that grips the device as said retaining member threads advance along said gripping end threads.

17. The apparatus of claim 16, wherein the compressible member comprises a gasket.

18. The apparatus of claim 17, wherein the gasket comprises an O-ring.

19. The apparatus of claim 15, wherein the gripping end further comprises one or more circumferentially spaced and longitudinally extending apertures dividing the gripping end into gripping portions, said gripping portions configured to collapse around the device as said retaining member threads advance along said gripping end threads.

20. The apparatus of claim 15, wherein the device comprises an illumination device.

21. The apparatus of claim 20, wherein the illumination device comprises a flashlight.

22. The apparatus of claim 15, wherein the device comprises a collection device.

23. The apparatus of claim 22, wherein the collection device comprises a sound collector.

* * * * *